US010762808B1

(12) United States Patent
Leclerc

(10) Patent No.: US 10,762,808 B1
(45) Date of Patent: Sep. 1, 2020

(54) HANDHELD PLACARD FOR EVENTS

(71) Applicant: John David Leclerc, Lincoln, RI (US)

(72) Inventor: John David Leclerc, Lincoln, RI (US)

(73) Assignee: Instafan, LLC, Lincoln, RI (US)

( * ) Notice: Subject to any disclaimer, the term of this patent is extended or adjusted under 35 U.S.C. 154(b) by 0 days.

(21) Appl. No.: 16/543,101

(22) Filed: Aug. 16, 2019

(51) Int. Cl.
*G09F 21/02* (2006.01)
*G09F 15/00* (2006.01)
*A45B 27/00* (2006.01)

(52) U.S. Cl.
CPC ..... *G09F 21/026* (2013.01); *G09F 15/0056* (2013.01); *A45B 27/00* (2013.01)

(58) Field of Classification Search
CPC .... G09F 21/026; G09F 15/0056; A45B 27/00
USPC ..... D3/1–4; 416/70 R, 70 A, 71
See application file for complete search history.

(56) References Cited

U.S. PATENT DOCUMENTS 893,096 A * 7/1908 Phlegar ..... F01D 21/045 416/2
1,352,385 A * 9/1920 Rothenhoefer ..... A45B 27/00 416/70 R
2,255,509 A * 9/1941 Lichter ..... A45B 27/00 416/70 R
2,401,615 A * 6/1946 Chittum ..... B65D 73/0021 40/124.18
4,761,904 A * 8/1988 Fast ..... G09F 3/18 40/308
D311,272 S * 10/1990 Sampson ..... D3/1
5,425,546 A * 6/1995 Gerber ..... B62B 3/1428 108/44
D391,072 S * 2/1998 Martin ..... D3/1
D429,559 S * 8/2000 Pecher ..... D3/1
6,516,546 B1 * 2/2003 Bremick ..... E06C 7/006 182/129
8,955,243 B2 * 2/2015 Dashe ..... G09F 1/06 40/539
2010/0003135 A1 * 1/2010 Meyerratken ..... A45B 27/00 416/71
2010/0139137 A1 * 6/2010 Coutu ..... G09F 1/02 40/586

FOREIGN PATENT DOCUMENTS

GB 2414331 A * 11/2005 ..... G09F 1/103
JP 2008220422 A * 9/2008

* cited by examiner

*Primary Examiner* — Cassandra Davis
(74) *Attorney, Agent, or Firm* — Dunlap Bennett & Ludwig, PLLC

(57) ABSTRACT

A handheld placard includes a body made of a rigid paper material. The body includes a front surface, a rear surface, a bottom edge, side edges, a top edge, and an inner edge defining a handle opening through the body. A handle flap extends downward from the bottom edge of the body and is connected to the bottom edge at a first fold line. The handle flap includes an upper portion joined to a lower portion by a second fold line.

11 Claims, 5 Drawing Sheets

HANDHELD PLACARD FOR EVENTS

BACKGROUND OF THE INVENTION

The present invention relates to a promotional product and, more particularly, to a handheld placard for events.

The rally towel and the foam finger promotional products to boost the fan experience at a sporting event. The problem of using graphics or advertising on a rally towel or foam finger at a sporting event is that you cannot see the sponsor or team's graphics on a spinning towel or a foam finger. Sponsors and teams who pay for these promotions are not benefiting from the money spent on advertising. Rally towels and foam fingers are also limited to one- or two-color printing for most volume applications due to high cost of printing multiple colors which limits the accuracy of reproducing a sponsor/team's logo, images, and tag line.

As can be seen, there is a need for an improved promotional product for large events.

SUMMARY OF THE INVENTION

In one aspect of the present invention, a handheld placard comprises: a body made of a rigid paper material and comprising a front surface, a rear surface, a bottom edge, side edges, a top edge, and an inner edge defining a handle opening through the body; and a handle flap extending downward from the bottom edge of the body and connected to the bottom edge at a first fold line, the handle flap comprising an upper portion joined to a lower portion by a second fold line, wherein the handle flap comprises a pre-folded configuration and a folded configuration, the pre-folded configuration comprising the handle flap substantially flat and the folded configuration comprising the upper portion of the handle flap folded upwards along the first fold line, and the lower portion folded through the handle opening along the second fold line.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The problem of using graphics or advertising on a sign or towel at a sporting event is that you cannot see the sponsor or graphics on a spinning towel. The present invention claimed here solves this problem. The present invention is the only promotional product that may be used at a sporting event with a call to action. The tear away perforated components cause fans to redeem same day promotional giveaways and/or purchase sponsor or team products later at participating outlets.

The present invention with a built-in corrugated handle can be printed on two sides, sponsors and advertisers have room for ad space and promotions and a break away bar code or QR code can be used for free or discounted product. Towels cannot do this.

The present invention is an improvement on what currently exists. The promotional sporting event towel is more expensive. It does not make noise and you cannot read what's on it. Sponsors have no visibility. The hand-held sign of the present invention can be printed on two sides with "Let's go Team!" and the back side can be printed with sponsor logos and text. The breakaway bar codes or QR code boxes can be used for free promotional items, raffles and discounted products. Also, the present invention can be used as a noise maker and a very useful fan.

A sporting event fan uses the sign to become part of the sporting experience by repeating what is printed on the sign in support of the team. The fan would not have to be prompted to be a fan by announcers or other spectators. Call to action: bar codes or QR codes printed on the sign can be torn off at the perforation and be used for free sponsored merchandise or discounted merchandise or even promotional raffles at the event. Free food, free car! Anything the event would like to offer. These bar codes or QR codes can be scanned on any smart phone and redeemed according to the team or the sponsor instructions.

The present invention is designed to be used at any sporting event such as football, baseball, hockey, basketball, and soccer and used to show a fan's interest, involvement and support of the team. It can double as a powerful noisemaker or a handheld cooling fan. It can be used to block the sun or as a portable lap top table to hold food or drinks. Team logos, team players, team rally calls, or popular sporting chants can be printed along with the team's sponsor's logos, marketing slogans and tag lines. One used the sign is 100% curbside recyclable and may contain up to 75% post-consumer recycled content.

Figure 2A:
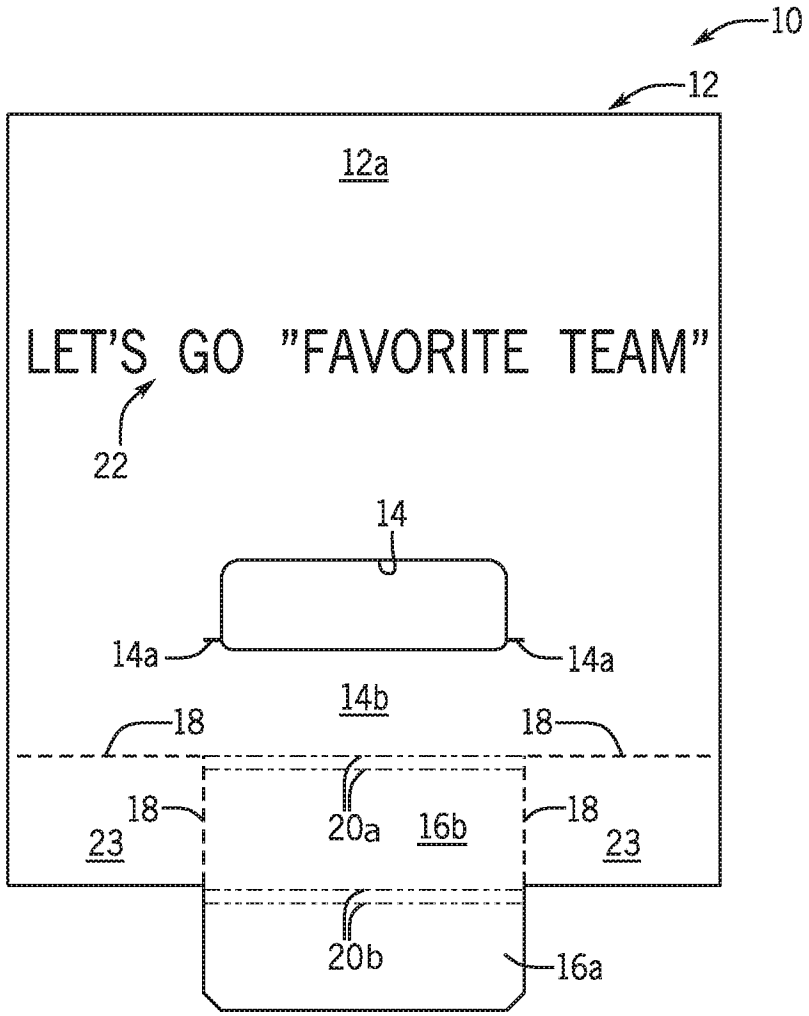
FIG. 2A is a front view of an embodiment of the present invention in a pre-folded configuration.
Figure 1:
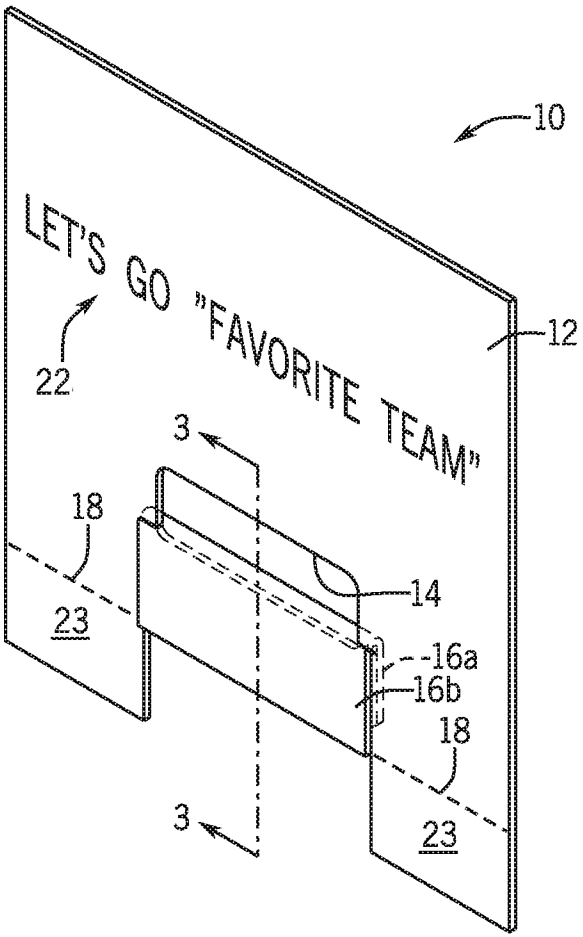
FIG. 1 is a front perspective view of an embodiment of the present invention in a folded configuration.
Figure 3:
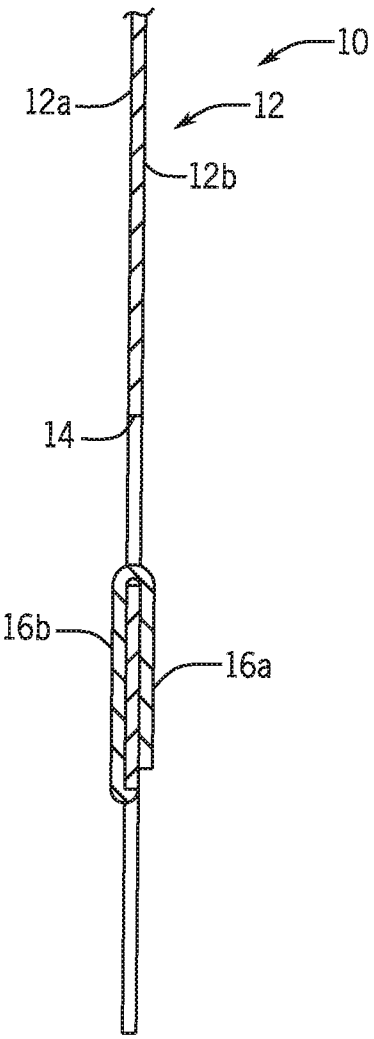
FIG. 3 is a cross-sectional view of the present invention taken along line 3-3 in FIG. 1.
Figure 2B:
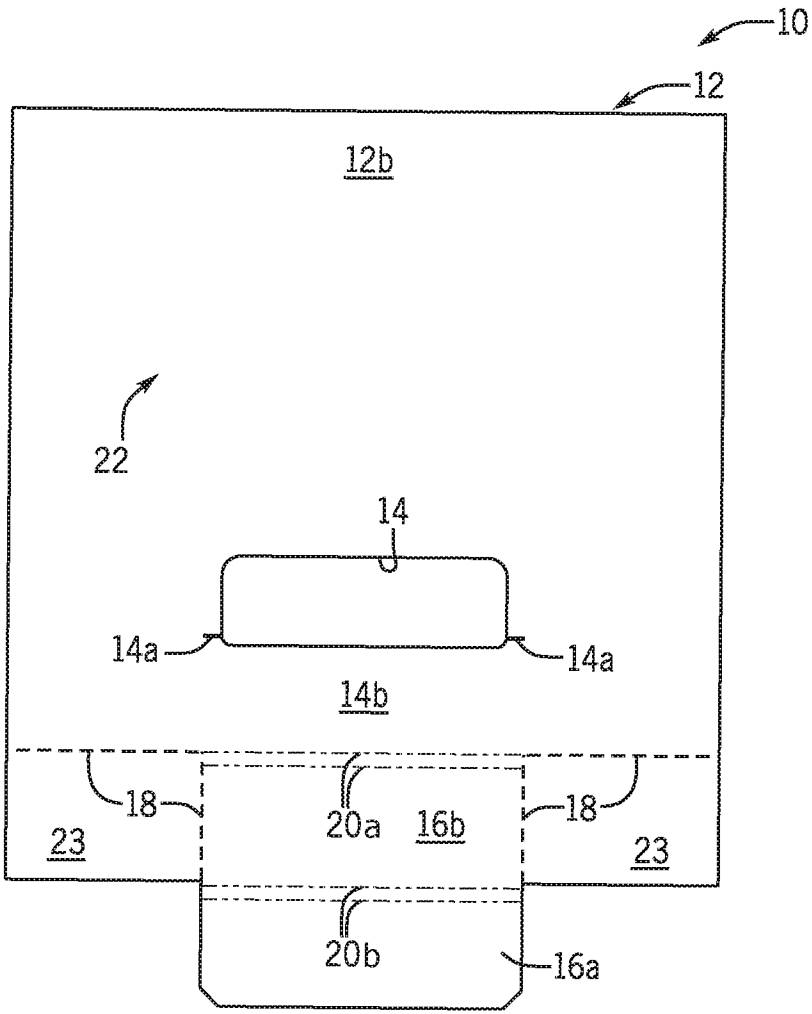
FIG. 2B is a rear view of an embodiment of the present invention in a pre-folded configuration.
Figure 4B:
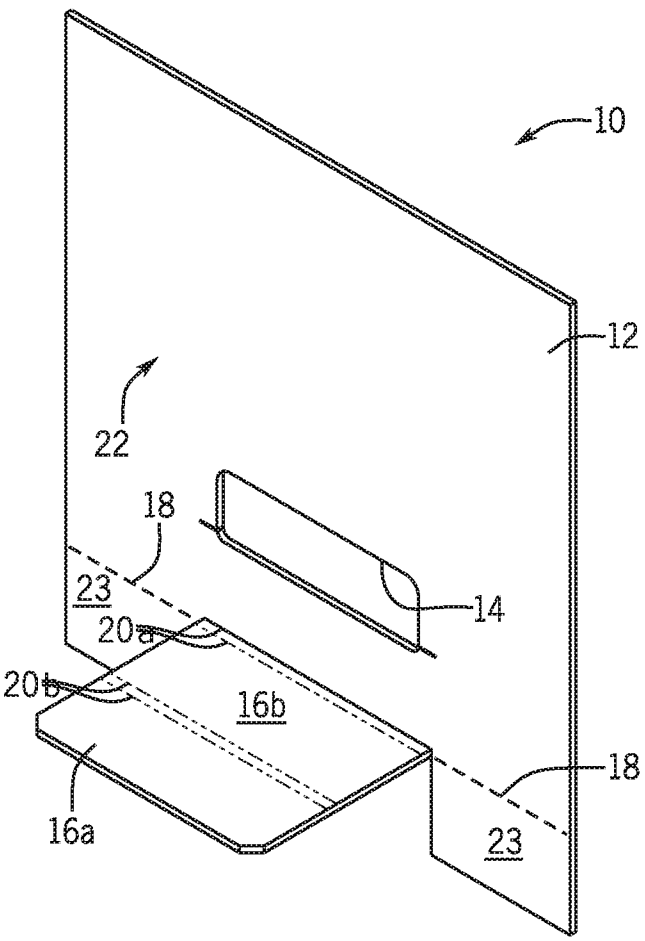
FIG. 4B is a perspective view of an embodiment of the present invention in a partially folded configuration.
Figure 4A:
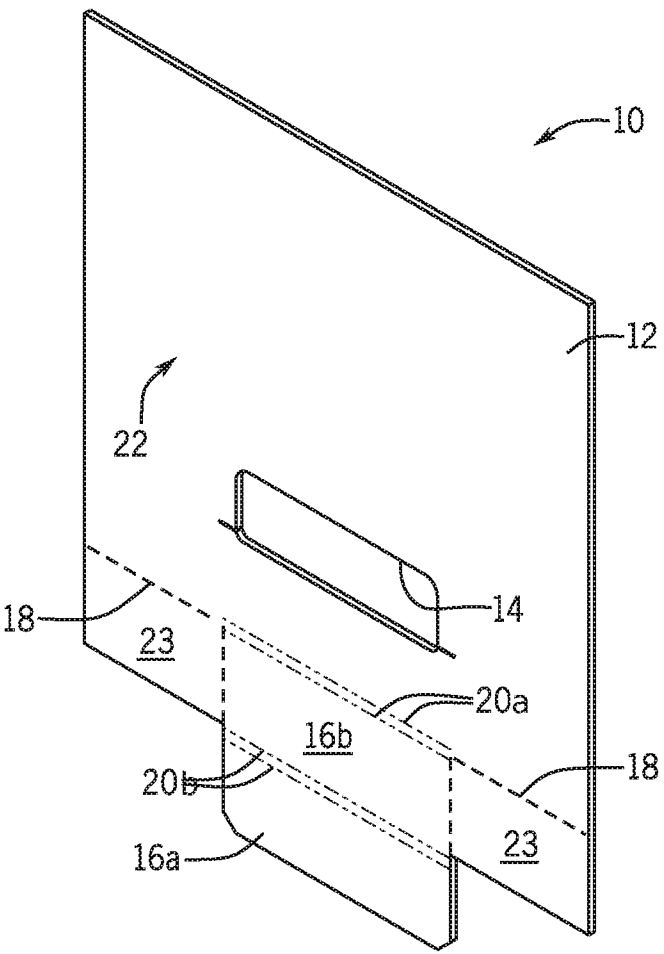
FIG. 4A is a perspective view of an embodiment of the present invention in a pre-folded configuration.
Figure 4D:
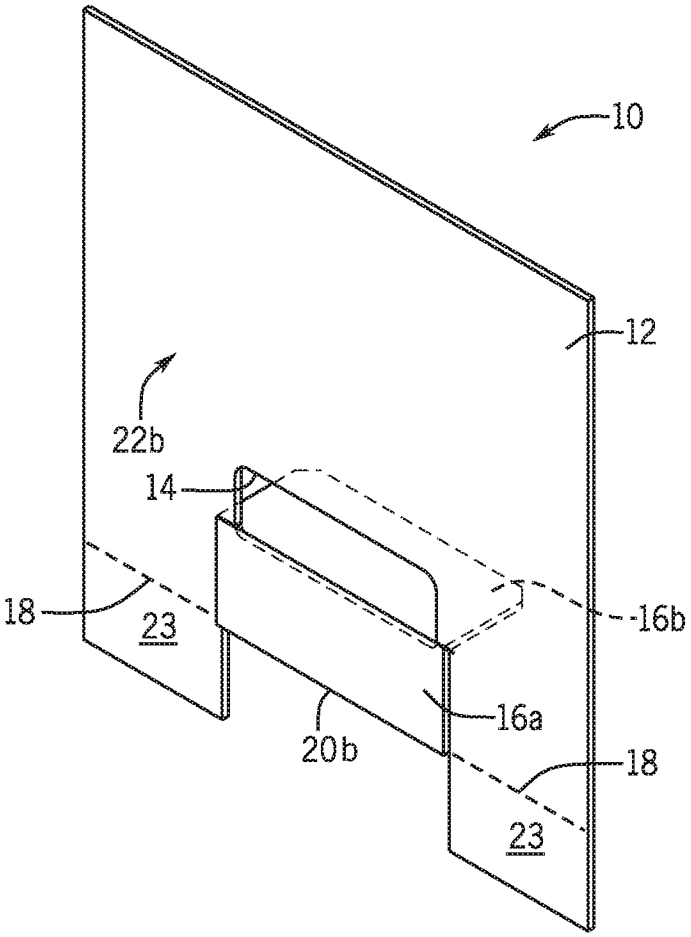
FIG. 4D is a perspective view of an embodiment of the present invention in a folded configuration.
Figure 4C:
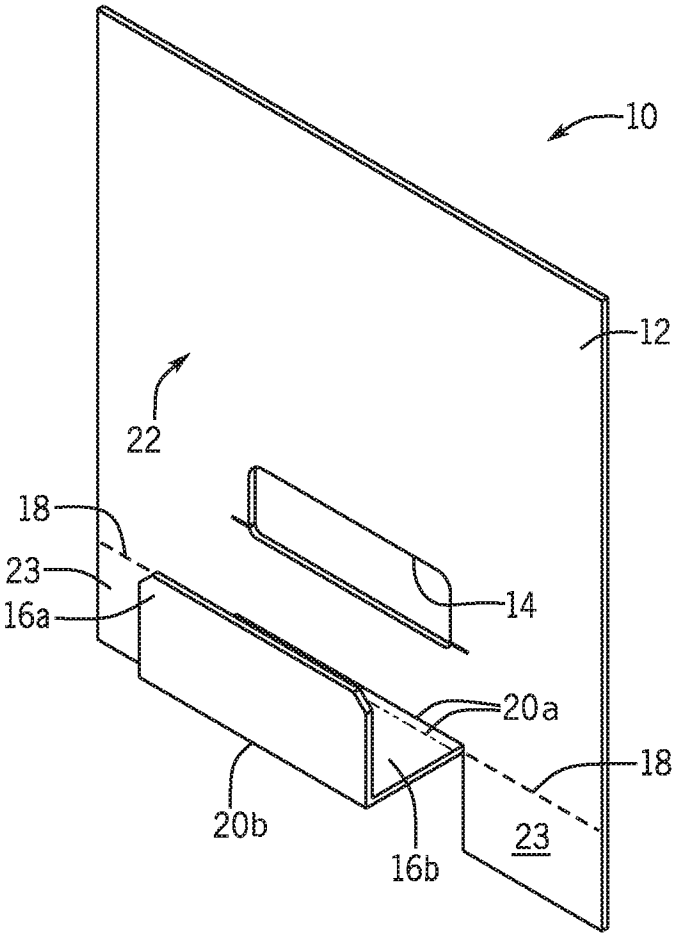
FIG. 4C is a perspective view of an embodiment of the present invention in a partially folded configuration.
Figure 5:
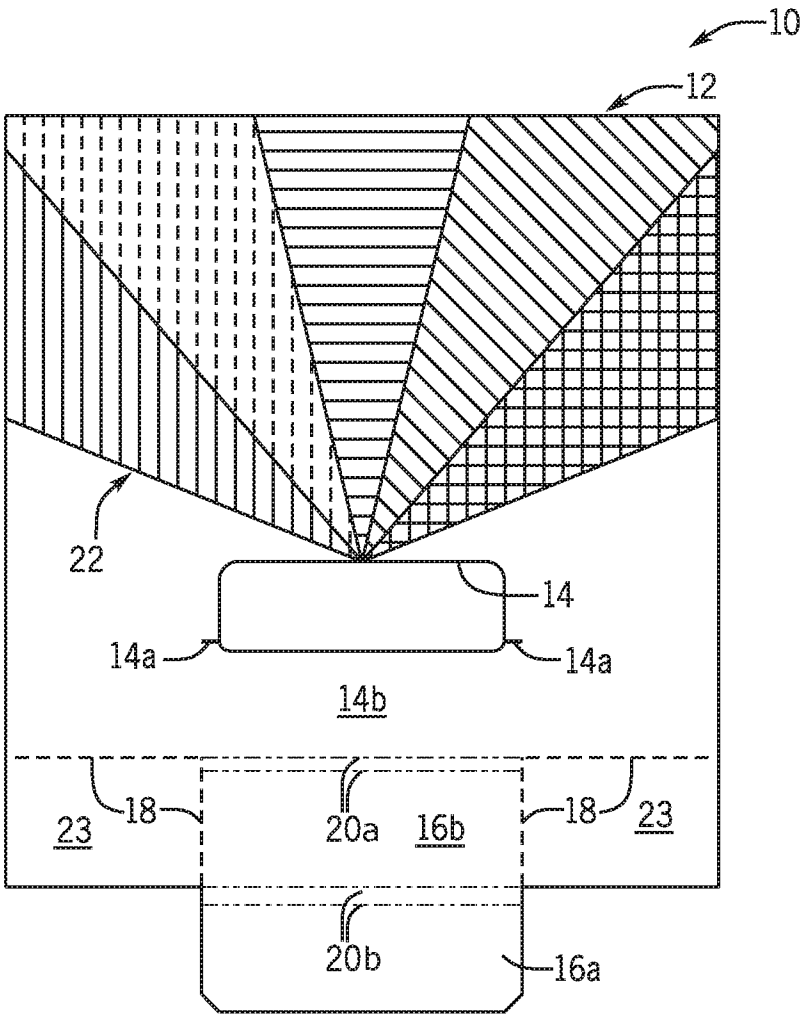
FIG. 5 is a front view of an embodiment of the present invention.

Referring to FIGS. 1 through 5, the present invention includes a handheld placard 10. The handheld placard 10 includes a body 12 made of a rigid flat paper material. The body 12 includes a front surface 12*a*, a rear surface 12*b*, a bottom edge, side edges, a top edge, and an inner edge 14. The inner edge 14 defines a handle opening through the body 12. A handle flap 16*a*, 16*b* extends downward from the bottom edge of the body 12 and is connected to the bottom edge at a first fold line 20*a*. The handle flap 16*a*, 16*b* includes an upper portion 16*b* joined to a lower portion 16*a* by a second fold line 20*b*.

The handle flap 16*a*, 16*b* includes a pre-folded configuration and a folded configuration. The pre-folded configuration includes the handle flap substantially flat and unfolded. The folded configuration includes the upper portion 16*b* of the handle flap 16*a*, 16*b* folded upwards along the first fold line 20*a*, and the lower portion 16*a* folded through the handle opening along the second fold line 20*b*.

In certain embodiments, the rigid paper material may be made of a corrugated cardboard. The cardboard materials may be recyclable. In such embodiments, the first fold line 20*a* and the second fold line 20*b* are depressions in the rigid paper material. In certain embodiments, the body 12 may be a square shape, a rectangular shape, a triangular shape, a circular shape, or other shape that may correspond with the team that the user is rooting for.

Graphics 22 may be printed on the front surface 12*a* and the rear surface 12*b* of the body 12. For example, the graphic 22 may include five colors per side with a shiny varnish to improve the detail and the crispness of the photo like graphics on both sides of the body 12. The present invention allows other members of a crowd to clearly see everything printed the body 12. For example, "GO RED SOX" may be printed on the front surface 12*a* and the sponsors and team products or services may be printed on the rear surface 12*b*. There is room to print multiple sponsor's logos to help defray the cost of the placard 10.

In certain embodiments, the body 12 further includes tabs 23 extending downward from the bottom edge on opposing sides of the handle flap 16*a*, 16*b*. The handle flap 16*a*, 16*b* may be joined to the tabs 23 at tear lines 18. The tear line 18 may include a plurality of perforations punched through the body 12 and aligned in a straight line. The tear lines 18 are broken when converting the handle flap 16*a*, 16*b* from the pre-folded configuration to the folded configuration.

In certain embodiments, the tabs 23 are each coupled to the bottom edge of the body by tear lines 18. Each of the tabs 23 may include a promotional coupon. The special tear away tabs 23 are printed with sponsor products or services and either barcoded or QR coded so the consumer can benefit from a game day promotion/raffle or for discounted products in-store at a later date.

The body 12 may further include slits 14*a* extending from bottom corners of the inner edge and towards the side edges of the body 12. The ends of the second fold line 20*b* fit within the slits 14*a* in the folded configuration. The slits 14*a* may retain the handle flap 16*a*, 16*b* within the handle opening. Once the handle flap 16*a*, 16*b* has been folded and secured, the user may hold the handheld placard at a handle portion 14*b* disposed in between the handle opening and the handle flap 16*a*, 16*b*.

A method of making the present invention may include the following. Corrugated liner board, medium and starch combine under heat and pressure on a corrugator machine to create a large corrugated sheet. This sheet is printed on a printing press with rotary cylinders on one or two sides of the corrugated sheet and then die cut in a rotary die cutting section of the machine or on a separate machine into the actual handheld sign.

A method of using the present invention may include the following. A fan folds in the integrated handle and become part of the overall sporting experience by repeating what is printed on the sign in support of the team. Additionally, a promotional QR or bar code printed on the sign can be easily teared off at the perforation and be used for free team or sponsored merchandise or discounted team or sponsored merchandise as well as game day promotional raffles at the event. The present invention may further be used as a noisemaker or personal cooling fan. The sign can be used at any sporting event such as football, baseball, hockey, basketball, soccer and used to show fan support. The front of the sign can be printed with a popular team chant and the back can be printed with team logos, team players, sponsor logos, tag lines and sponsor history.

It should be understood, of course, that the foregoing relates to exemplary embodiments of the invention and that modifications may be made without departing from the spirit and scope of the invention as set forth in the following claims.

What is claimed is:

1. A handheld placard comprising:

a body made of a rigid paper material and comprising a front surface, a rear surface, a bottom edge, side edges, a top edge, and an inner edge defining a handle opening through the body; and a handle flap extending downward from the bottom edge of the body and connected to the bottom edge at a first fold line, the handle flap comprising an upper portion joined to a lower portion by a second fold line, wherein the handle flap comprises a pre-folded configuration and a folded configuration, the pre-folded configuration comprising the handle flap substantially flat and the folded configuration comprising the upper portion of the handle flap folded upwards along the first fold line so that the upper portion is disposed against the front surface of the body, and the lower portion placed through the handle opening and folded downward along the second fold line so that the lower portion is disposed against the rear surface of the body.

2. The handheld placard of claim 1, wherein the first fold line and the second fold line are depressions in the rigid paper material.

3. The handheld placard of claim 1, wherein the rigid paper material is a corrugated cardboard.

4. The handheld placard of claim 1, wherein the body further comprises tabs extending downward from the bottom edge on opposing sides of the handle flap, wherein the handle flap is joined to the tabs at tear lines comprising a plurality of perforations, wherein the tear lines are broken when converting the handle flap from the pre-folded configuration to the folded configuration.

5. The handheld placard of claim 4, wherein the tabs are each coupled to the bottom edge of the body by tear lines comprising a plurality of perforations.

6. The handheld placard of claim 5, wherein each of the tabs is a promotional coupon.

7. The handheld placard of claim 1, wherein the body further comprises slits extending from bottom corners of the inner edge and towards the side edges.

8. The handheld placard of claim 7, wherein ends of the second fold line fit within the slits in the folded configuration.

9. The handheld placard of claim 1, wherein the body further comprises graphics disposed on at least one of the front surface and the rear surface.

10. The handheld placard of claim 1, wherein the body comprises a square shape.

11. A handheld placard comprising:

a body made of a rigid paper material and comprising a front surface, a rear surface, a bottom edge, side edges, a top edge, and an inner edge defining a handle opening through the body;

a handle flap extending downward from the bottom edge of the body and connected to the bottom edge at a first fold line, the handle flap comprising an upper portion joined to a lower portion by a second fold line, wherein the body further comprises tabs extending downward from the bottom edge on opposing sides of the handle flap, wherein the handle flap is joined to the tabs at tear lines comprising a plurality of perforations, and the handle flap comprises a pre-folded configuration and a folded configuration, the pre-folded configuration comprising the handle flap substantially flat and the folded configuration comprising the upper portion of the handle flap folded upwards along the first fold line, and the lower portion folded through the handle opening along the second fold line, wherein the tear lines are broken when converting the handle flap from the pre-folded configuration to the folded configuration.

* * * * *